US012590258B1

(12) United States Patent
Hommeltoft et al.

(10) Patent No.: US 12,590,258 B1
(45) Date of Patent: Mar. 31, 2026

(54) CONVERTING A LIPID FEEDSTOCK TO FUEL

(71) Applicant: CHEVRON U.S.A. INC., San Ramon, CA (US)

(72) Inventors: Sven Ivar Hommeltoft, Pleasant Hill, CA (US); David Andrew Slade, Ames, IA (US); Deirdra Ann Evers Mcgregor, Richmond, CA (US); Krege Matthew Christison, Martinez, CA (US); Martin Robert Haverly, Ames, IA (US)

(73) Assignee: CHEVRON U.S.A. INC., San Ramon, CA (US)

( * ) Notice: Subject to any disclaimer, the term of this patent is extended or adjusted under 35 U.S.C. 154(b) by 0 days.

(21) Appl. No.: 19/067,615

(22) Filed: Feb. 28, 2025

(51) Int. Cl.
*C10L 1/02* (2006.01)

(52) U.S. Cl.
CPC ..... *C10L 1/02* (2013.01); *C10L 2200/0415* (2013.01); *C10L 2200/0446* (2013.01); *C10L 2270/026* (2013.01)

(58) Field of Classification Search
CPC .. B01J 21/04; B01J 2229/16; B01J 2229/186; B01J 2229/36; B01J 29/7461; B01J 29/7469; B01J 29/80; B01J 35/643; B01J 37/0009; B01J 37/0201; B01J 37/08; B01J 37/10; B01J 37/18; B01J 2229/42; B01J 2523/822; B01J 2523/824; B01J 2523/828; B01J 35/19; B01J 35/394; B01J 35/50; B01J 35/51; B01J 35/60; B01J 35/615; C10G 45/64
See application file for complete search history.

(56) References Cited

U.S. PATENT DOCUMENTS

| | | | |
|---|---|---|---|
| 2,664,336 | A | 12/1953 | Cornell |
| 3,433,733 | A | 3/1969 | Bunn, Jr. et al. |
| 3,784,463 | A | 1/1974 | Reynolds et al. |
| 3,894,936 | A | 7/1975 | Hartley |

(Continued)

FOREIGN PATENT DOCUMENTS

| | | |
|---|---|---|
| CN | 102786966 | 11/2012 |
| EP | 2141217 B1 | 3/2015 |

(Continued)

OTHER PUBLICATIONS

Gibon et al., "Palm oil refining," Eur. J. Lipid. Sci. Technol. 109 (2007), 315-335.

(Continued)

*Primary Examiner* — Ellen M McAvoy
*Assistant Examiner* — Chantel Graham
(74) *Attorney, Agent, or Firm* — Sheppard, Mullin, Richter & Hampton LLP; Jaime D. Choi

(57) ABSTRACT

In some examples, a method of generating a fuel blend includes flowing a lipid feedstock into a reaction vessel comprising a metal oxide catalyst on an oxide support. The metal oxide catalyst in the reaction vessel is used to catalytically convert the lipid feedstock into a mixture comprising an intermediate composition having at least 70% of its oxygen within ketone groups. Distillation is used to obtain a distillation cut of the mixture. Without any further catalytic processing of the distillation cut, the distillation cut is blended with a fuel to create a fuel blend.

26 Claims, 2 Drawing Sheets

(56) References Cited

U.S. PATENT DOCUMENTS

| | | | |
|---|---|---|---|
| 4,007,131 | A | 2/1977 | Gilespie |
| 4,645,585 | A | 2/1987 | White |
| 4,880,574 | A | 11/1989 | Welsh |
| 5,145,490 | A | 9/1992 | Sadowski |
| 7,998,339 | B2 | 8/2011 | Myllyoja et al. |
| 8,350,102 | B2 | 1/2013 | Roberts, IV et al. |
| 8,354,065 | B1 | 1/2013 | Sexton et al. |
| 9,580,657 | B2 | 2/2017 | Heydenrych et al. |
| 9,903,584 | B2 | 2/2018 | Fan et al. |
| 10,190,059 | B2 | 1/2019 | Chapus et al. |
| 10,479,943 | B1 | 11/2019 | Liu et al. |
| 10,947,458 | B1 | 3/2021 | Tengfei et al. |
| 11,479,725 | B2 | 10/2022 | Amblard et al. |
| 11,555,153 | B1 | 1/2023 | Hommeltoft |
| 11,912,947 | B1 | 2/2024 | Hommeltoft |
| 12,139,673 | B2 | 11/2024 | Andersson et al. |
| 12,319,878 | B2 | 6/2025 | Hommeltoft |
| 12,319,881 | B1 | 6/2025 | Han et al. |
| 12,421,460 | B2 | 9/2025 | Hommeltoft |
| 12,434,224 | B2 | 10/2025 | Hommeltoft |
| 2007/0161832 | A1 | 7/2007 | Myllyoja et al. |
| 2008/0053870 | A1 | 3/2008 | Marker |
| 2009/0000185 | A1 | 1/2009 | Aulich et al. |
| 2009/0158637 | A1 | 6/2009 | McCall et al. |
| 2009/0300970 | A1 | 12/2009 | Perego |
| 2010/0043278 | A1 | 2/2010 | Brevoord |
| 2010/0163395 | A1 | 7/2010 | Henrich |
| 2011/0021857 | A1 | 1/2011 | Cao |
| 2011/0054230 | A1 | 3/2011 | Cole et al. |
| 2011/0056869 | A1 | 3/2011 | Novak et al. |
| 2011/0196113 | A1 | 8/2011 | Nesterenko |
| 2011/0237853 | A1 | 9/2011 | Hamamatsu et al. |
| 2012/0137572 | A1 | 6/2012 | Bartek et al. |
| 2012/0160741 | A1 | 6/2012 | Gong et al. |
| 2012/0203042 | A1 | 8/2012 | Huber et al. |
| 2012/0238787 | A1 | 9/2012 | Gruber et al. |
| 2012/0244585 | A1 | 9/2012 | Kale et al. |
| 2012/0251424 | A1 | 10/2012 | Havlik et al. |
| 2012/0258021 | A1 | 10/2012 | Badger |
| 2012/0316093 | A1 | 12/2012 | Zhan et al. |
| 2013/0006028 | A1 | 1/2013 | Chaogang et al. |
| 2013/0025187 | A1 | 1/2013 | Kocal et al. |
| 2013/0338409 | A1 | 12/2013 | Trewalla et al. |
| 2014/0012025 | A1 | 1/2014 | Sohling et al. |
| 2014/0109464 | A1 | 4/2014 | Powell et al. |
| 2014/0123973 | A1 | 5/2014 | North |
| 2014/0148609 | A1 | 5/2014 | Roussis et al. |
| 2014/0163285 | A1 | 6/2014 | Buchanan et al. |
| 2014/0171700 | A1 | 6/2014 | Roberts |
| 2015/0051428 | A1 | 2/2015 | Dayton |
| 2015/0087861 | A1 | 3/2015 | Devaux et al. |
| 2015/0141703 | A1 | 5/2015 | Dubois |
| 2018/0170824 | A1 | 6/2018 | Sreekumar |
| 2018/0258349 | A1 | 9/2018 | Heydenrych |
| 2019/0185759 | A1 | 6/2019 | Kanervo et al. |
| 2019/0299195 | A1 | 10/2019 | Nakazawa |
| 2021/0179952 | A1 | 6/2021 | Tsuto et al. |
| 2021/0380885 | A1 | 12/2021 | Mills |
| 2022/0041938 | A1 | 2/2022 | Hommeltoft |
| 2022/0048833 | A1 | 2/2022 | Drobyshev |
| 2022/0049172 | A1 | 2/2022 | Tiitta et al. |
| 2022/0145199 | A1 | 5/2022 | Kuo |
| 2022/0403252 | A1* | 12/2022 | Vilja ..... C10M 109/02 |
| 2023/0098592 | A1 | 3/2023 | Novak |
| 2024/0157320 | A1 | 5/2024 | Song et al. |
| 2024/0157347 | A1 | 5/2024 | Hommeltoft |
| 2024/0218261 | A1 | 7/2024 | Hommeltoft |
| 2024/0253028 | A1 | 8/2024 | Zhang |
| 2024/0425764 | A1 | 12/2024 | Hommeltoft |
| 2025/0027000 | A1 | 1/2025 | Hommeltoft |
| 2025/0333656 | A1 | 10/2025 | Hommeltoft |

FOREIGN PATENT DOCUMENTS

| | | | |
|---|---|---|---|
| FI | 20205954 | A1 | 3/2022 |
| FI | 20225933 | A1 | 4/2024 |
| FR | 2991596 | A1 | 12/2013 |
| WO | 2008/152199 | | 12/2008 |
| WO | 2009/130392 | | 10/2009 |
| WO | 2010071677 | | 6/2010 |
| WO | 2014/089131 | | 6/2014 |
| WO | 2015/148412 | | 10/2015 |
| WO | 2023/066738 | | 4/2023 |
| WO | 2023088772 | | 5/2023 |
| WO | 2024006239 | | 1/2024 |

OTHER PUBLICATIONS

Glowka et al., "Sustainable aviation fuel—Comprehensive study on highly selective isomerization route towards HEFA based bioadditives," Renewable Energy 220 (2024), 9 pages.

Huber et al., "Synthesis of Transportation Fuels from Biomass: Chemistry, Catalysts, and Engineering," Chem. Rev. (2006), 106, 4044-4098.

Mu et al., "Optimum design of radial flow moving-bed reactors based on a mathematical hydrodynamic model," Chemical Engineering and Processing 42 (2003), pp. 409-417.

Renz, "Ketonization of Carboxylic Acids by Decarbooxylation: Mechanism and Scope," Eur. J. Org. Chem. 2005, 979-988.

Shirzad et al., "Moving Bed Reactors: Challenges and Progress of Experimental and Theoretical Studies in a Century of Research," Ind. Eng. Chem. Res. 58 (2019), pp. 9179-9198.

Chen et al., "Catalytic fast pyrolysis of biomass: Selective deoxygenation to balance the quality and yield of bio-oil," Bioresource Technol., 273, pp. 153-158, 2019.

Chen et al., "Recent developments in ignocellulosic biomass catalytic fast pyrolysis: Strategies for the optimization of bio-oil quality and yield," Fuel Process Technol., 196, 106180, 2019.

Han et al., Advancing the application of bio-oils by co-processing with petroleum intermediates: A review, Energy Conversion and Management, 2021.

Liang et al., "Catalytic fast pyrolysis of lignocellulosic biomass: Critical role of zeolite catalysts," Renew. Sust. Energ. Rev., 139, 110707, 2021.

Zabeti et al., "Biodiesel production using alumina-supported calcium-oxide: An optimization study," Fuel Processing Technology 91 (2010) 243-248.

Zhang et al., "Superheated steam as carrier gas and the sole heat source to enhance biomass torrefaction," Bioresource Technology, 2021.

Zhou et al., "Catalytic conversion of lignocellulosic biomass to fine chemicals and fuels," Chem. Soc. Rev. 40, pp. 5588-5617, 2011.

Li et al., "Applications of calcium oxide-based catalyst in biomass pyrolysis/gasification—A review," Journal of Cleaner Production, 291, pp. 1-12, 2021.

Thangadurai et al., "Acidity and basicity of metal oxide based catalysts in catalytic cracking of vegetable oil," Brazilian Journal of Chemical Engineering, 38:1-20, 2021.

* cited by examiner

CONVERTING A LIPID FEEDSTOCK TO FUEL

FIELD

This application generally relates to renewable fuels.

BACKGROUND

There is an increasing interest in using lipid feedstocks, such as derived from plants, algae, animals, or microbiological organisms, to generate renewable fuels to replace or supplement fossil fuels. However, it may require several conventional steps to convert a lipid feedstock to a conventional renewable fuel, which may increase the time and expense of such conversion.

SUMMARY

Methods and systems for converting a lipid feedstock to fuel are provided herein.

Some examples herein provide a method of generating a fuel blend. The method may include flowing a lipid feedstock into a reaction vessel including a metal oxide catalyst on an oxide support. The method may include using the metal oxide catalyst in the reaction vessel to catalytically convert the lipid feedstock into a mixture including an intermediate composition having at least 70% of its oxygen within ketone groups. The method may include using distillation to obtain a distillation cut of the mixture. The method may include, without any further catalytic processing of the distillation cut, blending the distillation cut with a fuel to create a fuel blend.

In some examples, the distillation cut meets the Table 1 specifications of the ASTM D6751 standard.

In some examples, the fuel includes a petroleum fuel. In some examples, the petroleum fuel includes diesel. In some examples, the fuel blend meets the Table 1 specifications of the ASTM D7467 standard, other than the requirement that the fuel blend contain 6-20% (V/V) of biodiesel.

In some examples, the fuel includes a renewable fuel. In some examples, the renewable fuel includes biodiesel, hydrotreated lipids, or a mixture of biodiesel and hydrotreated lipids.

In some examples, the fuel blend meets the Table 1 specifications of the ASTM D7467 standard, other than the requirement that the fuel blend contain 6-20% (V/V) of biodiesel.

In some examples, the fuel blend includes 6-20% (V/V) biodiesel, and the fuel blend meets the ASTM D7467 standard.

In some examples, the fuel blend includes about 5% to about 50% by volume of the distillation cut. In some examples, the fuel blend includes about 5% to about 25% by volume of the distillation cut. In some examples, the fuel blend includes about 25% to about 50% by volume of the distillation cut. In some examples, the fuel blend includes more than about 50% by volume of the distillation cut. In some examples, the fuel blend includes more than about 75% by volume of the distillation cut. In some examples, the fuel blend includes more than about 90% by volume of the distillation cut.

In some examples, the distillation cut is from about 200° F. to about 750° F. In some examples, the distillation cut is from about 300° F. to about 680° F. In some examples, the distillation cut is from about 250° F. to about 600° F. In some examples, the distillation cut is from about 300° F. to about 600° F. In some examples, the distillation cut is from about 300° F. to about 550° F. In some examples, the distillation cut is from about 200° F. to about 550° F.

In some examples, at least 90% of carbon in the fuel blend is from a biological source. In some examples, at least 95% of carbon in the fuel blend is from a biological source.

Some examples herein provide a method of generating a fuel. The method may include flowing a lipid feedstock into a reaction vessel including a metal oxide catalyst on an oxide support. The method may include using the metal oxide catalyst in the reaction vessel to catalytically convert the lipid feedstock into a mixture including an intermediate composition having at least 70% of its oxygen within ketone groups. The method may include storing or transporting the mixture in its entirety, or a portion of the mixture, for use as a fuel without any further catalytic processing of the mixture.

In some examples, the mixture in its entirety is stored or transported for use as the fuel. In some examples, the fuel is marine fuel. In some examples, the mixture in its entirety meets the ISO 8217 standard.

In some examples, the method includes removing essentially only naphtha from the mixture to form the portion of the mixture that is stored or transported for use as the fuel. In some examples, the fuel is marine fuel. In some examples, the portion of the mixture meets the ISO 8217 standard. In some examples, the fuel is heating fuel. In some examples, the portion of the mixture meets the ASTM D396 standard.

Some examples herein provide a fuel blend. The fuel blend may include a distillation cut of a mixture including an intermediate composition having at least 70% of its oxygen within ketone groups; and a petroleum fuel.

In some examples, the petroleum fuel includes diesel.

In some examples, the distillation cut meets the Table 1 specifications of the ASTM D6751 standard.

In some examples, the mixture is formed by flowing a lipid feedstock into a reaction vessel including a metal oxide catalyst on an oxide support.

In some examples, the fuel blend consists essentially of the distillation cut and the petroleum fuel.

In some examples, the fuel blend includes about 5% to about 50% by volume of the distillation cut. In some examples, the fuel blend includes about 5% to about 25% by volume of the distillation cut. In some examples, the fuel blend includes about 25% to about 50% by volume of the distillation cut. In some examples, the fuel blend includes more than about 50% by volume of the distillation cut. In some examples, the fuel blend includes more than about 75% by volume of the distillation cut. In some examples, the fuel blend includes more than about 90% by volume of the distillation cut.

In some examples, the distillation cut is from about 200° F. to about 750° F. In some examples, the distillation cut is from about 300° F. to about 680° F. In some examples, the distillation cut is from about 250° F. to about 600° F. In some examples, the distillation cut is from about 300° F. to about 600° F. In some examples, the distillation cut is from about 300° F. to about 550° F. In some examples, the distillation cut is from about 200° F. to about 550° F.

Some examples herein provide a fuel blend. The fuel blend may include a distillation cut of a mixture including an intermediate composition having at least 70% of its oxygen within ketone groups; and a renewable fuel.

In some examples, the renewable fuel includes biodiesel, hydrotreated lipids, or a mixture of biodiesel and hydrotreated lipids.

In some examples, the fuel blend meets the Table 1 specifications of the ASTM D7467 standard, other than the requirement that the fuel blend contain 6-20% (V/V) biodiesel.

In some examples, the fuel blend comprises 6-20% (V/V) biodiesel, and the fuel blend meets the ASTM D7467 standard.

In some examples, the mixture is formed by flowing a lipid feedstock into a reaction vessel including a metal oxide catalyst on an oxide support.

In some examples, the fuel blend consists essentially of the distillation cut and the petroleum fuel.

In some examples, the fuel blend includes about 5% to about 50% by volume of the distillation cut. In some examples, the fuel blend includes about 5% to about 25% by volume of the distillation cut. In some examples, the fuel blend includes about 25% to about 50% by volume of the distillation cut. In some examples, the fuel blend includes more than about 50% by volume of the distillation cut. In some examples, the fuel blend includes more than about 75% by volume of the distillation cut. In some examples, the fuel blend includes more than about 90% by volume of the distillation cut.

In some examples, the distillation cut is from about 200° F. to about 750° F. In some examples, the distillation cut is from about 300° F. to about 680° F. In some examples, the distillation cut is from about 250° F. to about 600° F. In some examples, the distillation cut is from about 300° F. to about 600° F. In some examples, the distillation cut is from about 300° F. to about 550° F. In some examples, the distillation cut is from about 200° F. to about 550° F.

Some examples herein provide a marine fuel. The marine fuel may include a mixture including an intermediate composition having at least 70% of its oxygen within ketone groups.

In some examples, the marine fuel consists essentially of the mixture. In some examples, the mixture meets the ISO 8217 standard.

In some examples, the mixture is formed by flowing a lipid feedstock into a reaction vessel including a metal oxide catalyst on an oxide support.

Some examples herein provide a fuel. The fuel may include a mixture including an intermediate composition having at least 70% of its oxygen within ketone groups, the mixture substantially excluding naphtha.

In some examples, the fuel is marine fuel. In some examples, the portion of the mixture meets the ISO 8217 standard.

In some examples, the fuel is heating fuel. In some examples, the portion of the mixture meets the ASTM D396 standard.

In some examples, the mixture is formed by flowing a lipid feedstock into a reaction vessel including a metal oxide catalyst on an oxide support.

DETAILED DESCRIPTION

Figure 1:
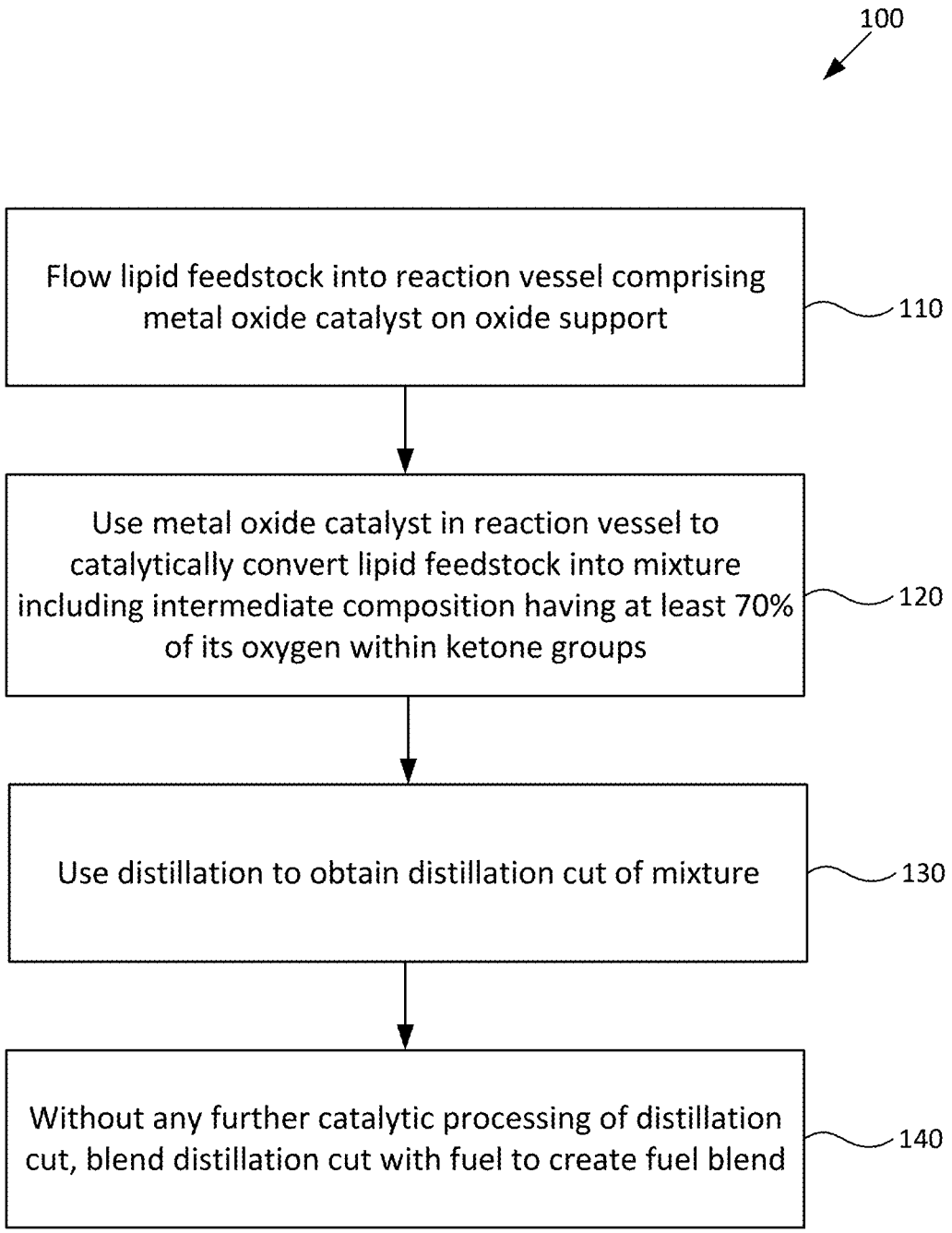
FIG. 1 illustrates an example flow of operations in a method for converting a lipid feedstock to a fuel.

A variety of renewable lipid feedstocks may be used to generate conventional renewable fuels, such as renewable diesel. However, conventional conversion techniques can be complicated and expensive, and may not be fully renewable. For example, fuels have been generated by transesterifying a lipid feedstock with light alcohol(s), such as methanol, to make a mixture of fatty acid methyl esters (FAME) known as biodiesel. ASTM standard D6751 defines biodiesel to be "fuel comprised of mono-alkyl esters of long chain fatty acids derived from vegetable oils or animal fats, designated B100." The conventional process for making biodiesel is well established, but the resulting product typically incorporates methanol made from natural gas rather than from a renewable resource, and may contain about 11 wt % oxygen.

As another example, fuels previously have been generated by directly hydroprocessing a lipid feedstock using a complex sequence of reaction steps including double bond saturation, hydro-deoxygenation, hydrocracking, and hydro-isomerization. In practice, such conversion process may use several reactors operating at high pressures (e.g., well in excess of 1000 psi hydrogen pressure). Additionally, because hydrogenation is highly exothermic, the rate at which such conversion process is performed may need to be severely restricted using recycle flow, thus limiting the conversion's overall throughput, e.g., by 50% or more. Still further, low Carbon Intensity (CI) lipid feedstocks may need to be extensively pretreated to remove impurities that either may passivate the hydroprocessing catalysts (e.g., metals or phosphorous) or that may challenge the metallurgy of the hydroprocessing units (e.g., chlorides), adding to the cost of production. Alternatively, a more pure, higher CI lipid feedstock may be used, which may reduce or avoid the need for pretreatment but nonetheless may add to the cost of production.

Such conventional hydroprocessing of lipid feedstocks may form a mixture of propane and distillate range hydrocarbons, where the latter are hydro-isomerized into renewable diesel. Conventional renewable diesel produced in this way is oxygen-free and contains carbon renewable resources. However, the hydroprocessing consumes substantial amounts of hydrogen which is typically produced from non-renewable resources. Additionally, the initially hydrogenated product is a wax, so conversion to a renewable diesel with acceptable cold flow properties requires extensive hydro-isomerization, adding to the cost of production.

These and other limitations of conventional, previously known methods of processing a lipid feedstock may limit throughput and increase cost and complexity, thus discouraging commercial implementation of renewable diesel and other renewable fuels. Additionally, these and other limitations of previously known methods of processing a lipid feedstock may use non-renewable resources, thus reducing any carbon savings from renewable diesel and other renewable fuels.

As provided herein, the present inventors have developed methods and systems for converting a lipid feedstock to a fuel that avoids the need to hydroprocess the lipid feedstock. More specifically, the present inventors have discovered that metal oxide catalyst on oxide supports may be used to catalytically convert a lipid feedstock into a mixture at least a portion of which is suitable for commercial use as a fuel, or for commercial use in a fuel blend, without further catalytic processing. For example, the mixture may include an intermediate composition having at least 70% of its oxygen within ketone groups. In some examples, distillation is used to obtain a distillation cut of the mixture, and without any further catalytic processing, the distillation cut may be blended with a fuel to create a fuel blend. In other examples, the entire mixture, or a portion of the mixture, may be stored or transported for use as a fuel without any further catalytic processing.

First, some example terms will be explained. Then, non-limiting examples of the present methods and systems will be described.

Example Terms

As used herein, the term "about" is intended to mean within 10% of the stated value.

As used herein, the term "primarily" is intended to mean a majority, e.g., at least half. Illustratively, a composition which primarily has components with boiling point above a certain level, means that at least half of the composition is made up of components with boiling point about that level. The term "primarily" encompasses all ranges from at least a half to 100%, e.g., 51% or more, about 60% or more, about 70% or more, about 80% or more, about 90% or more, or about 95% or more, or about 98% of more, or about 99% or more, or about 100%.

As used herein, the term "substantially" is intended to mean significantly. Illustratively, a concentration of a component within a first composition which is substantially less than the concentration of that component within a second composition, means that the concentration of that component within the first composition is less than about 20% of the concentration within the second composition, e.g., less than about 10%, less than about 5%, less than 1%, or even less. As another example, a reaction that is performed using substantially only certain components means that of all the components which are present at the reaction, at least about 80%, at least about 90%, at least about 95%, at least about 98%, at least about 99%, or about 100% are the certain components.

As used herein, the term "lipid" is intended to refer to a fatty acid; glyceride (e.g., monoglyceride or diglyceride); glycerolipid (e.g., triglyceride, also referred to as triacylglycerol, TAG, or neutral fat); phospholipid; or phosphoglyceride (also known as glycerophospholipid).

As used herein, the term "fatty acid" is intended to refer to a monocarboxylic acid having an aliphatic chain containing about 3 to 39 carbon atoms, illustratively about 7 to 23 carbon atoms. The aliphatic chain may be linear or branched, and may be saturated (e.g., may contain no carbon-carbon double bonds) or may be unsaturated (e.g., may contain one or more carbon-carbon double bonds).

As used herein, a "lipid feedstock" is intended to refer to a composition which is derived from a biological source, rather than from a fossil fuel source such as crude oil, shale oil, or coal, and primarily contains lipids. For example, a lipid feedstock may contain more than 50 wt % lipids, may contain more than 70 wt % lipids, may contain more than 85 wt % lipids, may contain more than 90 wt % lipids, may contain more than 95 wt % lipids, or more. A lipid feedstock may be derived from a plant, algae, animal, or microbiological organism. In some examples, a lipid feedstock may be derived from a low value waste material, side stream, by-product, residue, or sewage sludge. A lipid feedstock may be pretreated in a manner such as known in the art, for example, may be degummed, neutralized, bleached, and/or deodorized.

Depending on the source and the pretreatment (if any), a lipid feedstock may contain a mixture of different lipids. Illustratively, a lipid feedstock may include about 0-90 weight percent (wt %) of free fatty acids, about 5-100 wt % of fatty acid glycerol esters (e.g., monoglycerides, diglycerides, and/or triglycerides), and about 0-20 wt % of one or more compounds selected from the group consisting of: fatty acid esters of the non-glycerol type, fatty amides, and fatty alcohols. In some examples, the lipid feedstock may include more than about 50 wt % of free fatty acids and fatty acid glycerol esters, e.g., more than about 70 wt % of free fatty acids and fatty acid glycerol esters, or more than about 80 wt % of free fatty acids and fatty acid glycerol esters. The concentration of free fatty acids in a lipid feedstock may be characterized by determining the total acid number (TAN) of the feedstock, by measuring the mass of potassium hydroxide (KOH) in milligrams that is required to neutralize one gram of the lipid feedstock; see also ASTM D664. In some examples, a lipid feedstock may have a TAN of at least about 5 mg KOH/g, e.g., about 5-150 mg KOH/g, or about 10-150 mg KOH/g, or about 10-100 mg KOH/g, or about 10-50 mg KOH/g, or about 10-25 mg KOH/g, or about 10-20 mg KOH/g. A lipid feedstock may contain one or more impurities, such as phosphorous, silicon, chloride, an alkali metal such as sodium or potassium, an alkaline earth metal such as magnesium or calcium, a metal such as manganese or iron, or the like.

As used herein, the term "intermediate composition" is intended to refer to a liquid product that is produced from a lipid feedstock using a thermochemical process, and that may be used directly as a renewable fuel or may be further processed (e.g., blended into another fuel) to generate an at least partially renewable fuel. In some examples, the intermediate compositions provided herein may include less than about 70 wt % of an amount of oxygen in the lipid feedstock. An intermediate composition may include oxygenated hydrocarbons such as carboxylic acids, alcohols, ketones, aldehydes, and the like. In some examples, about 10 wt % to 50 wt % of the molecules of a liquid portion of the intermediate composition includes oxygen, and about 50 wt % or more of the molecules of the liquid portion of the intermediate composition do not include oxygen. In some examples, at least about 70 wt %, or at least about 80 wt %, of the oxygen in the liquid portion of the intermediate composition is within ketone groups.

As used herein, the term "pyrolysis" is intended to refer to the thermal decomposition of organic materials in an oxygen-lean atmosphere (that is, an atmosphere containing significantly less oxygen than required for complete combustion).

As used herein, the term "hydroprocessing" is intended to refer to a process in which a composition is reacted with hydrogen in the presence of a catalyst under suitable conditions, e.g., elevated temperature and/or elevated pressure. Nonlimiting examples of hydroprocessing include hydrogenation, double bond saturation, hydrodeoxygenation, hydrocracking, hydro-isomerization, hydrodesulfurization, hydrodenitrogenation, hydrodearomatization, hydrodewaxing, and mild hydrocracking.

As used herein, the term "transportation fuel" refers to a fraction, cut, or blend of hydrocarbons having a distillation curve which is standardized for use in the transportation industry. For example, diesel fuel corresponds to a middle distillate from 160° C. to 380° C. (according to EN 590). Gasoline and naphtha are other standardized, well-characterized forms of transportation fuels. For example, naphtha has a boiling point of about 20° C. to about 100-150° C. When a transportation fuel is derived from a lipid feedstock (e.g., via an intermediate composition in a manner such as provided herein), then the transportation fuel may be referred to herein as a "renewable fuel." When a fuel (such as a transportation fuel, e.g., renewable fuel) is ready for use without substantial further processing, it may be referred to herein as a "final product." The final product may be conveyed to a site of use in any suitable manner, e.g., by pipeline, truck, and/or rail.

As used herein, the term "ppm" is intended to refer to parts-per-million and is a weight-relative parameter. A ppm is a microgram per gram, such that a component that is present at 10 ppm in a composition is present at 10 micrograms of the component per 1 gram of the composition.

Converting Lipid Feedstocks to Fuel

As noted further above, conventional, previously known methods of processing lipid feedstocks into fuel may be complex, time consuming, and costly, and may use non-renewable resources. The present inventors have discovered that the present systems and methods may be used to efficiently and cost-effectively convert lipid feedstocks into finished fuel which may be at least partially or fully derived from renewable resources.

FIG. 1 illustrates an example flow of operations in a method for converting a lipid feedstock to a fuel. Method 100 illustrated in FIG. 1 may include flowing the lipid feedstock into a reaction vessel including a metal oxide catalyst on an oxide support (operation 110). Nonlimiting examples of lipid feedstocks are provided further above. The lipid feedstock may be flowed over any suitable metal oxide catalyst. In some examples, the metal oxide catalyst includes at least one metal selected from the group consisting of Na, K, Mg, Ca, Sr, and a rare earth metal. Illustratively, the metal oxide catalyst may include at least one metal selected from the group consisting of Na, K, Ca, and Mg. In some examples, the metal of the metal oxide catalyst may be an alkali metal such as lithium, sodium, or potassium. In some examples, the metal of the metal oxide catalyst may be an alkaline earth metal such as magnesium, strontium, or calcium.

In one nonlimiting example, the metal oxide catalyst may include calcium oxide, and in some examples may consist essentially of calcium oxide, or may consist of calcium oxide. The calcium within the calcium oxide catalyst may be in oxidation state 2 (as in CaO), but it may be in any suitable chemical form and is not limited to exclusively CaO. Additionally, the chemistry of the calcium oxide catalyst may change over time and/or with exposure to the lipid feedstock. For example, the calcium oxide catalyst initially may be in the form of CaO, CaO(OH), or $Ca(OH)_2$, or a mixture thereof. In operation, the calcium may be in the form of a mixture of any such compounds and/or in the form of carbonate or carboxylate. Additionally, or alternatively, the calcium may become partially embedded in the oxide support as aluminate, e.g., oxy-aluminate and/or hydroxy-aluminates. The metal oxide catalyst may be supported on any suitable oxide support, such as alumina. In some examples, the lipid feedstock is flowed over substantially no other solid-state materials besides the metal oxide catalyst (e.g., calcium oxide catalyst or other alkaline earth metal oxide catalyst) on the oxide support (e.g., alumina).

Figure 2:
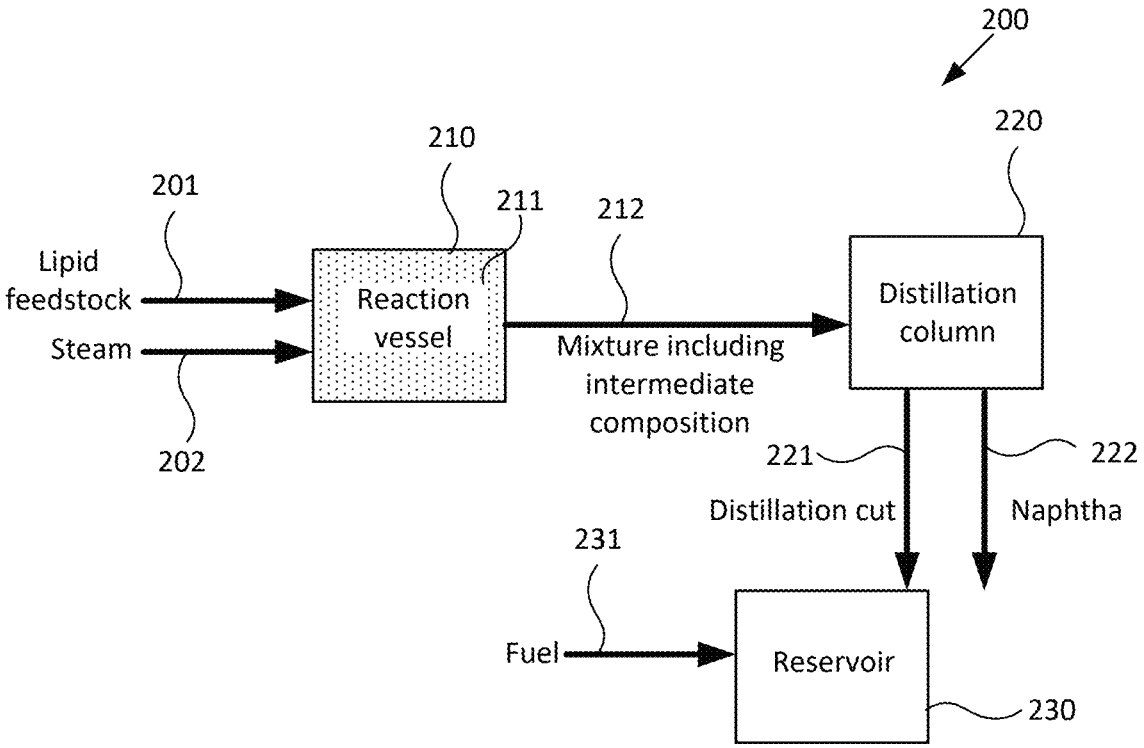
FIG. 2 schematically illustrates an example system for converting a lipid feedstock to a fuel.

The lipid feedstock may be flowed over the metal oxide catalyst in any suitable reaction vessel(s). Although the oxide support may not specifically be mentioned in all cases, it will be understood that the metal oxide catalyst is supported by the oxide support. FIG. 2 schematically illustrates an example system for converting a lipid feedstock to a fuel. In the nonlimiting example illustrated in FIG. 2, system 200 may include reaction vessel 210 in which metal oxide catalyst 211 is disposed. Piping 201 may be coupled to a first inlet of reaction vessel 210 such that lipid feedstock may be flowed into reaction vessel 210 and across metal oxide catalyst 211. Piping 202 may be coupled to a second inlet of reaction vessel 210 such that steam may be flowed into reaction vessel 210 and across metal oxide catalyst 211 together with the lipid feedstock.

In some examples, the metal oxide catalyst 211 is in a fixed bed over which the lipid feedstock is flowed, the metal oxide catalyst and the feedstock may be brought into contact with one another in any suitable manner. In other examples, the metal oxide catalyst 211 instead may be in a fluid bed, or in a moving bed. It will be appreciated that the metal oxide catalyst on the oxide support may have any suitable configuration for use in the particular reaction vessel 210. In some examples, the metal oxide catalyst on the oxide support includes particles with sizes in the range of about 0.01 mm to about 5 mm. In nonlimiting examples in which a fixed bed reaction is used, the metal oxide catalyst on the oxide support may include (or in some cases may consist essentially of) particles with sizes in the range of about 1 mm to about 5 mm. In nonlimiting examples in which a fluid bed reaction is used, the metal oxide catalyst on the oxide support may include (or in some cases may consist essentially of) particles with sizes in the range of about 0.05 mm to about 0.2 mm. In nonlimiting examples in which a moving bed reaction is used, the metal oxide catalyst on the oxide support may include (or in some cases may consist essentially of) particles with sizes in the range of about 0.05 mm to about 0.2 mm.

The metal oxide catalyst on the oxide support additionally, or alternatively, may have any suitable combination of properties, e.g., bulk density, particle density, packed density, pore volume, large pore content, average pore diameter, and/or surface area. Illustratively, the metal oxide catalyst may have one or more of the following properties, or any suitable combination of two or more of the following properties: a bulk density in the range of about 0.78 kg/l to about 0.86 kg/l; a particle density in the range of about 1.2 kg/l to about 1.4 kg/l; a packed density in the range of about 0.8 g/cc to about 1.0 g/cc; a pore volume in the range of about 0.42 to about 0.48 cc/g; a large pore content (pores>1000 Å) of about 0.30 cc/g to about 0.38 cc/g; an average pore diameter (D50) of about 100 Å to about 200 Å; and/or a surface area of about 50 $m^2/g$ to about 150 $m^2/g$. Additionally, or alternatively, the metal oxide catalyst may have one or more of the following properties, or any suitable combination of two or more of the following properties: a bulk density in the range of about 0.80 kg/l to about 0.84 kg/l; a particle density in the range of about 1.1 kg/l to about 1.3 kg/l; a packed density in the range of about 0.85 g/cc to about 0.95 g/cc; a pore volume in the range of about 0.44 to about 0.46 cc/g; a large pore content (pores>1000 Å) of about 0.33 cc/g to about 0.36 cc/g; an average pore diameter (D50) of about 130 Å to about 160 Å; and/or a surface area of about 80 $m^2/g$ to about 120 $m^2/g$.

Referring again to FIG. 1, method 100 further may include using the metal oxide catalyst in the reaction vessel to catalytically convert the lipid feedstock into a mixture which includes an intermediate composition having at least 70% of its oxygen within ketone groups (operation 120). The lipid feedstock may be reacted with the metal oxide catalyst under any suitable combination of reaction conditions to generate the mixture. In various examples, the catalytic conversion may be performed at a temperature of about 400° C. to about 700° C., illustratively about 425° C. to about 600° C., e.g., about 450° C. to about 550° C., e.g., about 475° C. to about 500° C. Additionally, in some examples, the catalytic conversion may be performed at a pressure in the range of about 0.01 MPa to about 10 MPa, illustratively about 0.1 to about 5 MPa, e.g., about 0.1 to about 1 Mpa. Additionally, in some examples, the catalytic conversion may be performed at a liquid hourly space velocity (LHSV) in the range of about 0.1 $h^{-1}$ to about 10 $h^{-1}$, illustratively about 0.2 $h^{-1}$ to about 5 $h^{-1}$, or about 0.3 $h^{-1}$ to about 3 $h^{-1}$, or about 0.5 $h^{-1}$ to about 1.5 $h^{-1}$. LHSV may be calculated as the volume of lipid feedstock per volume of catalyst per hour.

In some examples, the catalytic conversion of the lipid feedstock to the mixture uses steam as an additional input to the reaction vessel, e.g., via piping 202 coupled to a second inlet of reaction vessel 210 illustrated in FIG. 2. The steam may inhibit cracking and coke formation. In some examples, the steam is provided in an amount of about 0 wt % to about 50 wt %, and its use is optional. Some examples use substantially only steam and the lipid feedstock as inputs to the reaction vessel 210 for reactions which are catalyzed by the metal oxide catalyst on the oxide support. That is, hydrogen may not be separately input to reaction vessel 210. Additionally, the steam may not be a reactant in the reactions between the lipid feedstock and the metal oxide catalyst on the oxide support, e.g., may not be a source of hydrogen for such reactions. In some examples, the steam is omitted.

The reaction(s) performed using the metal oxide catalyst may reduce the amount of oxygen in the lipid feedstock. For example, the intermediate composition may include less than about 70 wt % of an amount of oxygen in the lipid feedstock. Additionally, the reaction(s) performed using the metal oxide catalyst may modify the location(s) of oxygen within the molecules being reacted. For example, at least about 70 wt %, or at least about 80 wt % of the oxygen in the liquid portion of the intermediate composition may be within ketone groups. In comparison, in some examples, the lipid feedstock substantially may not include any ketone groups.

As provided herein, in addition to converting the lipid feedstock to the mixture, the metal oxide catalyst on the oxide support also may be used to remove impurities from the renewable feedstock during operation 120, for example without the use of a separate catalyst. Indeed, the catalytic conversion described with reference to FIGS. 1 and 2 may remove multiple contaminants. In some examples, the intermediate composition lacks a detectable amount of metal. In some examples, the intermediate composition lacks a detectable amount of phosphorous. In some examples, intermediate composition lacks a detectable amount of chlorine. The amount (if any) of metal, phosphorous, and/or certain other contaminants may be measured in any suitable manner, such as inductively coupled plasma-mass spectrometry (ICP). In some examples, an organic chloride contaminant level can be determined by X-ray Fluorescence Spectroscopy, e.g., ASTM D7536-09, Standard Test Method for Chlorine in Aromatics by Monochromatic Wavelength Dispersive X-ray Fluorescence Spectrometry. In other examples, chlorine content may be determined using combustion ion chromatography (CIC), a technique in which a sample is burned in an oxygen-containing gas flow, the gas generated (including halogen ions) is absorbed by a solution, and then the halogen content of the solution is quantitatively analyzed using ion chromatography. Additionally, or alternatively, in some examples, chlorine content may be determined using X-ray fluorescence to determine chloride content with a detection limit of about 1 ppm.

When it is described herein that a composition "lacks a detectable amount" of an element, it means that the amount of that element in the composition is approximately at or below than the measurement threshold of the respective instrument being used to measure that element. Of course, different instruments may have different measurement thresholds than one another. In some examples, the instrument has a measurement threshold of about 5 ppm, and the intermediate composition has a concentration of less than about 5 ppm of metal, phosphorous, and/or chlorine. In some examples, the instrument has a measurement threshold of about 1 ppm, and the intermediate composition has a concentration of less than about 1 ppm of metal, phosphorous, and/or chlorine. In other examples, the instrument has a measurement threshold of about 0.5 ppm, and the intermediate composition has a concentration of less than about 0.5 ppm of metal, phosphorous, and/or chlorine. In still other examples, the instrument has a measurement threshold of about 0.1 ppm, and the intermediate composition has a concentration of less than about 0.1 ppm of metal, phosphorous, and/or chlorine.

Illustratively, in the nonlimiting example illustrated in FIG. 2, system 200 may include piping 212 coupled to an outlet of reaction vessel 210 such that the mixture including the intermediate composition, which is generated by reaction of the lipid feedstock with the metal oxide catalyst 211 within vessel 210, may be flowed out of reaction vessel 210. The metal oxide catalyst 211 may be regenerated at any suitable time, and in any suitable manner. For example, in nonlimiting configurations in which the metal oxide catalyst is in a fixed bed, the lipid feedstock inlet may be turned off, and air may be provided to the reaction vessel 210 to stimulate a combustion process therein which burns coke from the metal oxide catalyst 211.

In some examples, system 200 may include reservoir 230 which is coupled directly or indirectly to piping 212 and configured to receive the mixture or a portion thereof. The mixture in its entirety, or a portion of the mixture, may be stored in reservoir 230 for use as a fuel without any further catalytic processing of the mixture. Reservoir 230 may be located in a fixed position or may be portable, e.g., may located on a tanker truck or tanker ship to transport the mixture or portion thereof to another location for further processing which is non-catalytic and/or for use as a fuel.

In nonlimiting examples in which the mixture in its entirety is stored or transported for use as the fuel, reservoir 230 may be coupled directly to piping 212 to collect the mixture for such storage or transport. Illustratively, the mixture in its entirety may be stored, transported, and/or used as marine fuel. For example, the mixture in its entirety may meet the ISO 8217 standard, e.g., ISO 8217:2024, entitled "Products from petroleum, synthetic and renewable sources—Fuels (class F)—Specifications of marine fuels," published by the International Standards Organization (Edition 7, 2024), the entire contents of which are incorporated by reference herein. Accordingly, some examples herein provide a marine fuel that includes a mixture comprising an intermediate composition having at least 70% of its oxygen within ketone groups. The marine fuel may consist essentially of the mixture. The mixture may be formed by flowing a lipid feedstock into a reaction vessel comprising a metal oxide catalyst on an oxide support, e.g., by performing operations 110 and 120 described with reference to FIG. 1, using reaction vessel 210 described with reference to FIG. 2, to form the mixture without performing operations 130 and/or 140 described with reference to FIG. 1, and storing the marine fuel in reservoir 230.

In nonlimiting examples in which a portion of the mixture is stored or transported for use as the fuel, reservoir 230 may be indirectly coupled to piping 212 via one or more other components configured to further process the mixture, without any further catalytic processing. Illustratively, referring again to FIG. 1, method 100 may include using distillation to obtain a distillation cut of the mixture (operation 130). For example, as illustrated in FIG. 2, piping 212 may directly or indirectly couple reaction vessel 210 to distillation column 220 which is configured to generate the distillation cut of the mixture including the intermediate composition. Distillation column 220 may be coupled to reservoir 230 via piping 221. The distillation cut may be stored in reservoir 230 and/or may be transported for use as a fuel or in a fuel blend, e.g., in a manner such as described herein.

Whether the distillation cut obtained in operation 130 is used directly as a fuel or is blended with a fuel to create a fuel blend, the distillation range of the cut may be selected to provide suitable properties of the final product. Illustratively, a product with a higher initial boiling point (IBP, lower end of stated range) is expected to have a higher flash point, while a product with a lower end point (EP, higher end of stated range) is expected to have better cold flow properties. In various nonlimiting examples, the distillation cut may be from about 200° F. to about 750° F., e.g., from about 300° F. to about 680° F., or from about 250° F. to about 600° F., e.g., from about 300° F. to about 600° F., e.g., from about 300° F. to about 550° F., or from about 200° F. to about 550° F. Illustratively, a distillation cut in the range of about 300° F. to about 680° F. suitably may be used as a diesel #2 fuel blend component or as a direct diesel #2 fuel. A distillation cut in the range of about 250° F. to about 600° F. suitably may be used as a diesel #1 fuel blend component or as a direct diesel #1 fuel, or in some examples may be used as a diesel #2 fuel blend component or as a direct diesel #2 fuel. A distillation cut in the range of about 300° F. to about 600° F. suitably may be used as either a diesel #1 or diesel #2 fuel blend component or as a direct diesel #1 or diesel #2 fuel. A distillation cut in the range of about 300° F. to about 550° F. suitably may be used as a diesel #1 fuel blend component or as a direct diesel #1 fuel; or suitably may be used as a diesel #2 fuel blend component; or may be hydrotreated to remove oxygen and unsaturation and suitably used as a jet fuel component. A distillation cut in the range of about 200° F. to about 550° F., with a sufficiently high flash point (38° C.) suitably may be used as a diesel #1 fuel blend component or a direct diesel #1 fuel.

In some examples, operation 130 may include removing essentially only naphtha from the mixture to form the portion of the mixture that is stored or transported for use as the fuel. Such examples may be suitable for preparing marine fuel (e.g., meeting the ISO 8217 standard). Additionally, or alternatively, such examples may be suitable for preparing heating fuel (e.g., meeting the ASTM D396 standard, e.g., ASTM D396-21, entitled "Standard Specification for Fuel Oils," published by ASTM International (May 6, 2024), the entire contents of which are incorporated by reference herein). In such examples, the portion of the mixture from which essentially only the naphtha is removed may be used as a fuel without any blending or further processing (especially without any further catalytic processing). Accordingly, some examples herein provide a fuel that includes, or consists essentially of, a mixture that includes an intermediate composition having at least 70% of its oxygen within ketone groups, and that substantially excludes naphtha. The fuel may be a marine fuel (e.g., meeting the ISO 8217 standard) or may be a heating fuel (e.g., meeting the ASTM D396 standard). The mixture may be formed by flowing a lipid feedstock into a reaction vessel comprising a metal oxide catalyst on an oxide support, e.g., by performing operations 110 and 120 described with reference to FIG. 1, using reaction vessel 210 described with reference to FIG. 2 to form the mixture; and performing operation 130 to remove the naphtha, using distillation column 220 (e.g., to piping 222 illustrated in FIG. 2); without performing operation 140; and storing the fuel in reservoir 230.

In still other examples, the distillation cut may be blended with a fuel to create a fuel blend. For example, referring again to FIG. 1, method 100 may include, without any further catalytic processing of the distillation cut, blending the distillation cut with fuel to create a fuel blend (operation 140). For example, as illustrated in FIG. 2, piping 221 may be used to flow the distillation cut into reservoir 230 where the distillation cut is blended with fuel 231 which is flowed into reservoir 230 via piping 231.

The distillation cut may meet the requirements in Table 1 of the ASTM D6751 standard, set forth below. Note, however, that the distillation cut may not meet ASTM D6751's definition of a "biodiesel," because the distillation cut may not be "fuel comprised of mono-alkyl esters of long chain fatty acids derived from vegetable oils or animal fats." Nonetheless, because the distillation cut meets all of the requirements of Table 1 of ASTM D6751, the distillation cut suitably may be commercially used in place of a "biodiesel."

ASTM D6751, Table 1. Detailed requirements for Biodiesel (B100) blend stocks.

| Property | Test Method | Grade No. 1-B S15 | Grade No. 1-B S500 | Grade No. 2-B S15 | Grade No. 2-B S500 |
|---|---|---|---|---|---|
| Sulfur, % mass (ppm), max | ASTM D5453 | 0.0015 (15) | 0.05 (500) | 0.0015 (15) | 0.05 (500) |
| Cold soak filterability, seconds, max | ASTM D7501 | 200 | 200 | 360 | 360 |
| Mono-glyceride content, % mass, max | ASTM D6584 | 0.40 | 0.40 | . . . | . . . |
| Calcium and Magnesium, combined, ppm (μg/g), max | EN 14538 | 5 | 5 | 5 | 5 |
| Flash point (closed cup), ° C., min | ASTM D93 | 93 | 93 | 93 | 93 |
| Alcohol control: one of the following (1) or (2) shall be met: | | | | | |
| (1) Methanol content, mass %, max | EN 14110 | 0.2 | 0.2 | 0.2 | 0.2 |
| (2) Flash point, ° C., min | ASTM D93 | 130 | 130 | 130 | 130 |
| Water and sediment, % volume, max | ASTM D2709 | 0.050 | 0.050 | 0.050 | 0.050 |
| Kinematic viscosity, $mm^2/s$, 40° C. | ASTM D445 | 1.9-6.0 | 1.9-6.0 | 1.9-6.0 | 1.9-6.0 |
| Sulfated ash, % mass, max | ASTM D874 | 0.020 | 0.020 | 0.020 | 0.020 |
| Copper strip corrosion, max | ASTM D130 | No. 3 | No. 3 | No. 3 | No. 3 |
| Cetane | ASTM | 47 | 47 | 47 | 47 |

-continued

ASTM D6751, Table 1. Detailed requirements for Biodiesel (B100) blend stocks.

| Property | Test Method | Grade No. 1-B S15 | Grade No. 1-B S500 | Grade No. 2-B S15 | Grade No. 2-B S500 |
|---|---|---|---|---|---|
| number, min | D613 | | | | |
| Cloud point, ° C. | ASTM D2500 | Report value | Report value | Report value | Report value |
| Carbon residue, % mass, max | ASTM D4530 | 0.050 | 0.050 | 0.050 | 0.050 |
| Acid number, mg KOH/g, max | ASTM D664 | 0.50 | 0.50 | 0.50 | 0.50 |
| Free glycerin, % mass, max | ASTM D6584 | 0.020 | 0.020 | 0.020 | 0.020 |
| Total glycerin, % mass, max | ASTM D6584 | 0.240 | 0.240 | 0.240 | 0.240 |
| Phosphorus content, % mass, max | ASTM D4951 | 0.001 | 0.001 | 0.001 | 0.001 |
| Distillation temperature, Atmospheric equivalent temperature, 90 % recovered, ° C., max | ASTM D1160 | 360 | 360 | 360 | 360 |
| Sodium and Potassium, combined, ppm (μg/g), max | EN 14538 | 5 | 5 | 5 | 5 |
| Oxidation stability, hours, min | EN 15751 | 3 | 3 | 3 | 3 |

In the above table, "Report value" means there are no limits for this property in the ASTM D6751 standard, but a test result should be provided because it provides useful information, and because there potentially may be a contractual limit.

Optionally, the distillation cut may be blended with any suitable fuel in operation 140. In some examples, the fuel may include, or may consist essentially of, a petroleum fuel. Illustratively, the petroleum fuel may include, or may consist essentially of, diesel. The fuel blend, which may include, or may consist essentially of, petroleum diesel and the distillation cut, may meet the requirements of Table 1, set forth below, of the ASTM D7467 standard, e.g., ASTM D7467-19, "Standard Specification for Diesel Fuel Oil, Biodiesel Blend (B6 to B20)," published by ASTM International (2019), the entire contents of which are incorporated by reference herein, other than for the standard's requirement that the fuel blend contain 6-20% (V/V) of biodiesel. That is, similarly as noted above, the distillation cut may not meet ASTM D-6751's or ASTM D7467's definition of a "biodiesel," because the distillation cut may not be "fuel comprised of mono-alkyl esters of long chain fatty acids derived from vegetable oils or animal fats." As such, the blend of petroleum diesel and the distillation cut may not meet ASTM D7467's definition of "B6 to B20" because the blend may not consist of "6 volume percent to 20 volume percent biodiesel conforming to the requirements of Specification D6751 with the remainder being a light middle or middle distillate grade diesel fuel and meeting the requirements of this specification." Nonetheless, because the fuel blend meets all of the requirements of Table 1 of ASTM D7467 other than the standard's requirement that the fuel blend contain 6-20% (V/V) of biodiesel, the fuel blend suitably may be commercially used in place of a "B6 to B20" blend.

ASTM D7467, Table 1. Detailed requirements for B6 to B20 Biodiesel Blends.

| Property | Test Method | Grade No. B6 to B20 S15 | Grade No. B6 to B20 S500 | Grade No. B6 to B20 S5000 |
|---|---|---|---|---|
| Acid number, mg KOH/g, max | ASTM D664 | 0.3 | 0.3 | 0.3 |
| Viscosity, $mm^2/s$ at 40° C. | ASTM D445 | 1.9-4.1 | 1.9-4.1 | 1.9-4.1 |
| Flash Point, ° C., min | ASTM D93 | 52 | 52 | 52 |
| Cloud Point, ° C., max or LTFT/CFPP, ° C., max | ASTM D2500, D4539, D6371 | ** | ** | ** |
| Sulfur content, (μg/g) mass percent, max | ASTM D5453 | 15 | . . . | . . . |
| Sulfur content, (μg/g) mass percent, max | ASTM D2622 | . . . | 0.05 | . . . |
| Sulfur content, (μg/g) mass percent, max | ASTM D129 | . . . | . . . | 0.50 |
| Distillation temperature, ° C., 90% vol recovered, max | ASTM D86 | 343 | 343 | 343 |
| Ramsbottom carbon residue on 10% bottoms, mass %, max | ASTM D524 | 0.35 | 0.35 | 0.35 |
| Cetane number, min | ASTM D613 | 40 | 40 | 40 |
| One of the following (1) or (2) shall be met: | | | | |
| (1) Cetane index, min. | ASTM D976-80 | 40 | 40 | 40 |
| (2) Aromaticity, volume percent, max | ASTM D1319-03 | 35 | 35 | . . . |
| Ash content, mass percent, max | ASTM D482 | 0.01 | 0.01 | 0.01 |
| Water and sediment, volume percent, max | ASTM D2709 | 0.05 | 0.05 | 0.05 |
| Copper corrosion, 3 h at 50° C., max | ASTM D130 | No. 3 | No. 3 | No. 3 |
| Biodiesel content, % (V/V) | ASTM D7371 | 6.-20. | 6.-20. | 6.-20. |
| Oxidation stability, hours, min | EN 15751 | 6 | 6 | 6 |
| Lubricity, HFRR at 60° C., micron (μm), max | ASTM D6079 | 520 | 520 | 520 |
| Conductivity (pS/m) or Conductivity Units (C.U.), min | ASTM D2624/D4308 | 25 | 25 | 25 |

In the above table, ** designates that, according to Table 1 of the ASTM D7467 standard, low temperature properties that will ensure satisfactory operation at all ambient conditions may not realistically be specified.

Alternatively, the fuel blend may include, or consist essentially of, petroleum diesel and a mixture of biodiesel and the distillation cut. In some examples, the fuel blend may meet ASTM D7467's definition of "B6 to B20" because the blend may consist of 6 volume percent to 20 volume percent biodiesel conforming to the requirements of Specification D6751 with the remainder being a light middle or middle distillate grade diesel fuel and meeting the requirements of this specification. In this case, the fuel blend may fully meet all of the requirements of ASTM D7467 (including all of the requirements of Table 1 of this standard), that is, may be commercially sold and used as a "B6 to B20" blend.

For further details regarding other acceptable test methods, other requirements that may apply in certain circumstances and/or in certain jurisdictions, and the like, see the ASTM D6751 and ASTM D7467 standards. The respective current versions of all standards mentioned herein are hereby incorporated by reference in their entireties.

In other examples, the fuel may include, or may consist essentially of, a renewable fuel. Illustratively, the renewable fuel may include, or may consist essentially of, biodiesel, hydrotreated lipids, or a mixture of biodiesel and hydrotreated lipids. In some examples, the fuel blend, which may include, or may consist essentially of, renewable biodiesel, hydrotreated lipids, or a mixture of biodiesel and hydrotreated lipids, and the distillation cut, may meet the Table 1 specifications of the ASTM D7467 standard, other than the requirement that the fuel blend contain 6-20% (V/V) of biodiesel. In still other examples, the fuel blend includes 6-20% (V/V) biodiesel, and the fuel blend meets the ASTM D7467 standard.

The present fuel blends, e.g., the distillation cut in any suitable combination with petroleum fuel, and/or biodiesel, may be blended in any suitable proportion to obtain a fuel blend having the desired characteristics (e.g., may have flash point and/or cold flow properties selected to meet a particular standard such as listed elsewhere herein). In some examples, the fuel blend may include about 5% to about 50% by volume of the distillation cut, e.g., about 5% to about 25% by volume of the distillation cut, or about 25% to about 50% by volume of the distillation cut. In all such examples, the balance of the fuel blend may be, or may consist essentially, the fuel with which the distillation cut is blended, where such fuel may include any suitable proportion of petroleum fuel and/or biodiesel. In other examples, the fuel blend may include more than about 50% by volume of the distillation cut, e.g., more than about 75% by volume of the distillation cut, or more than about 90% by volume of the distillation cut. In all such examples, the balance of the fuel blend may be, or may consist essentially, the fuel (e.g., petroleum fuel and/or biodiesel) with which the distillation cut is blended.

One thing that can be taken into consideration for the present fuel blends is that depending on the cut points for the material, the cold temperature properties such as Cloud Point (CP), Pour Point, and/or Cold Filter Plugging Point (CFPP) may be improved relative to conventional renewable diesel and conventional biodiesel. For example, the distribution of molecules in the mixture formed in operation 120 is continuous, similar to a petroleum fuel and different from a conventional biodiesel or conventional renewable diesel which is concentrated in the C16-C18 range. Making a lighter cut of the present mixture may provide better cold temperature behavior. Direct data to support this is the comparison of the cloud point for "light diesel" versus "diesel" formed of different distillation cuts of the present mixture. A light diesel fuel formed of a distillation cut having a boiling range of 250-300° F. was observed to have a CP of −71° C., while a diesel fuel formed of a distillation cut having a boiling range of 300-680° F. was observed to have a CP of −2.0° C. By adjusting the cut points, the CP of the material can be tailored. Generally, a high blend percentage of a low cloud point material may have marketing advantages in cold temperature markets. For example, a distillation cut in about the 250-550° F. range may be blended at relatively high ratios and have better cold temperature properties relative to conventional renewable diesel and conventional biodiesel and certain petroleum diesels.

It will be appreciated that a wide variety of fuel blends are provided herein. The properties of the fuel blend may be controlled via the IBP and EP of the particular distillation cut selected, the particular fuel (e.g., petroleum fuel and/or biodiesel) with which the distillation cut is blended, and the relative amounts of the distillation cut and fuel in the fuel blend. The amount of carbon in the fuel blend which is from a biological source (e.g., is renewable) depends on the particular proportion of the distillation cut to the fuel with which the distillation cut is blended, and the source from which the fuel is derived. In examples in which the distillation cut is blended with a renewable fuel (such as biodiesel), at least 90% of carbon, or even at least 95% of carbon, or even up to 100% of carbon in the fuel blend may be from a biological source. In examples in which the distillation cut is blended with a renewable fuel, the amount of carbon in the fuel blend which is from a biological source is proportional to the amount of distillation cut in the fuel blend.

In a purely illustrative example, a fuel blend is provided herein that includes a distillation cut of a mixture comprising an intermediate composition having at least 70% of its oxygen within ketone groups; and a petroleum fuel. Optionally, the fuel blend may consist essentially of the distillation cut and the petroleum fuel. The petroleum fuel may, in some examples, include diesel. The distillation cut may meet the requirements of Table 1 of the ASTM D6751 standard. Additionally, or alternatively, the fuel blend may meet the requirements of Table 1 of the ASTM D7467 standard, other than the requirement that the fuel blend include 6-20% (V/V) of biodiesel. In a manner such as described with reference to FIGS. 1 and 2, the mixture may be formed by flowing a lipid feedstock into a reaction vessel comprising a metal oxide catalyst on an oxide support. The fuel blend may include about 5% to about 50% by volume of the distillation cut, e.g., about 5% to about 25% by volume of the distillation cut, or about 25% to about 50% by volume of the distillation cut. Alternatively, the fuel blend may include more than about 50% by volume of the distillation cut, e.g., more than about 75% by volume of the distillation cut, or more than about 90% by volume of the distillation cut. Generally, 5 vol % or less biodiesel is considered to be a diesel fuel within the ASTM D975 specification, e.g., ASTM D975-21, "Standard Specification for Diesel Fuel," published by ASTM International (2021), the entire contents of which are incorporated by reference herein. As described elsewhere herein, 6-20% biodiesel in diesel fuel has its own specification ASTM D7467. The distillation cut may be from any suitable temperature range, such as from about 200° F. to about 750° F., e.g., from about 300° F. to about 680° F., e.g., from about 250° F. to about 600° F., e.g., from about 300° F. to about 600° F., e.g., from about 300° F. to about 550° F., or from about 200° F. to about 550° F. Nonlimiting examples of fuel blends and/or fuels in which such distillation cuts may be used are described elsewhere herein.

In a purely illustrative example, a fuel blend is provided herein that includes a distillation cut of a mixture comprising an intermediate composition having at least 70% of its oxygen within ketone groups; and a renewable fuel. Optionally, the fuel blend may consist essentially of the distillation cut and the renewable fuel. The renewable fuel may, in some examples, include renewable fuel comprises biodiesel, hydrotreated lipids, or a mixture of biodiesel and hydrotreated lipids. In some examples, the fuel blend may include 6-20% (V/V) biodiesel, and may meet all of the requirements of the ASTM D7467 standard. Additionally, or alternatively, in some examples, the fuel blend may meet the Table 1 requirements of the ASTM D7647 standard. Additionally, or alternatively, in still other examples, the distillation cut may meet all of the requirements of Table 1 of the ASTM D6751 standard. Additionally, or alternatively, in yet other examples, the fuel blend may meet all of the requirements of Table 1 of the ASTM D7647 standard, excluding the requirement that the fuel blend include 6-20% (V/V) of biodiesel. In a manner such as described with reference to FIGS. 1 and 2, the mixture may be formed by flowing a lipid feedstock into a reaction vessel comprising a metal oxide catalyst on an oxide support. The fuel blend may include about 5% to about 50% by volume of the distillation cut, e.g., about 5% to about 25% by volume of the distillation cut, or about 25% to about 50% by volume of the distillation cut. Alternatively, the fuel blend may include more than about 50% by volume of the distillation cut, e.g., more than about 75% by volume of the distillation cut, or more than about 90% by volume of the distillation cut. The distillation cut may be from any suitable temperature range, such as from about 200° F. to about 750° F., e.g., from about 300° F. to about 680° F., e.g., from about 250° F. to about 600° F., e.g., from about 300° F. to about 600° F., e.g., from about 300° F. to about 550° F., or from about 200° F. to about 550° F. Nonlimiting examples of fuel blends and/or fuels in which such distillation cuts may be used are described elsewhere herein.

It has previously been expected that to be useful as fuels, lipid feedstocks would need to be hydroprocessed, either directly or following conversion to an intermediate composition. However, it has been discovered that the systems and methods described with reference to FIGS. 1 and 2 may be used to produce a mixture of components, including an intermediate composition, that surprisingly may be used as a fuel without the need for hydroprocessing. Without being bound by a particular theory, it is believed that in the present systems and methods, heavier components of the mixture that have a boiling point that is too high for evaporation under the conditions in the reaction vessel tend to remain in the liquid phase in the reaction vessel until they convert further into lighter products that evaporate in the reaction vessel and are carried out of the reaction vessel with the treated stream. It is further understood that the systems and methods described with reference to FIGS. 1 and 2 restructure the carbon chains in the fatty acids of the lipids. In some examples, the intermediate composition is or includes a mixture of essentially non-acidic hydrocarbons and oxygenates, primarily ketones, with chain lengths varying from significantly shorter than the original fatty acid chain length to considerably longer than the original fatty acid chain length. This phenomenon yields a mixture, including an intermediate composition, that is particularly useful for producing fuels and/or fuel blends, e.g., using systems and operations such as described with reference to FIGS. 1 and 2.

In some examples, the mixture, including the intermediate composition, exiting reaction vessel 210 may be separated into the following components: 1) renewable fuel gas including (and, in some examples, consisting essentially of) C1 and C2 hydrocarbons with a boiling point range of about 0° C. to about 20° C., 2) a renewable liquefied petroleum gas (LPG) including (and, in some examples, consisting essentially of) C3 and C4 hydrocarbons with a boiling point range of about 20° C. to about 150° C., 3) a renewable intermediate transportation fuel including (and, in some examples, consisting essentially of) hydrocarbons in the range of C5 to C20 with a boiling point range of about 150° C. to about 360° C., and 4) a heavy ends product including (and, in some examples, consisting essentially of) hydrocarbons in the range of C21 to C35 with a boiling point range of about 360° C. to about 490° C. Such separation may be performed, for example, using distillation in a manner such as known in the art.

In some examples, such separation may be used to obtain a liquid portion of the intermediate composition having the following characteristics:

(1) naphtha (boiling point of about 20° C. to about 100-150° C.) of greater than 10 wt % and less than about 30 wt % in the intermediate composition;
(2) intermediate transportation fuel (boiling point of about 100-150° C. to about 360° C.) of greater than about 40 wt % and less than about 60 wt % in the intermediate composition; and
(3) heavy ends product (boiling point of about 360° C. to about 490° C.) of less than about 30 wt % in the intermediate composition.

In some examples, the liquid portion of the intermediate composition may be further characterized as having greater than 90% of its carbon content being renewable carbon of biological (as opposed to fossil/mineral) origin as measured by standard C14 radiocarbon analysis. In some examples, the liquid portion of the intermediate composition may be further, or alternatively, characterized as having an oxygen content in the range of 1-4 wt %. In some examples, the liquid portion of the intermediate composition can be further, or alternatively, characterized as having an NMR branching index of greater than about 14%, wherein the NMR branching index is defined as the integral of the protons in the methyl region of 0.5 to 0.95 ppm as a percentage of the integral of the entire aliphatic proton resonances region of 0.5 to 2.1 ppm. In some examples, the liquid portion of the intermediate composition may be further, or alternatively, characterized as having about 10 wt % to about 50 wt % of oxygen containing molecules and/or at least about 50 wt % of oxygen-free hydrocarbons.

In some examples, the liquid portion of the intermediate composition can be further, or alternatively, characterized as having more than about 70 wt %, or more than about 80 wt %, of the oxygen in the product being in the form of ketone groups. Additionally, or alternatively, in some examples, the liquid portion of the intermediate composition may be characterized as having and at least about 10 wt % of the oxygen in the form of methyl ketones (Me-C(O)—R).

In some examples, the liquid portion of the intermediate composition can be further, or alternatively, characterized as having a total acid number (TAN) of less than 1.

In one nonlimiting example, an intermediate transportation fuel portion of the liquid intermediate composition that is suitable for use in a fuel (e.g., may be used directly as a fuel, or may be incorporated into a fuel blend) without hydroprocessing may be characterized as:

(1) having greater than 90% of its carbon content being renewable carbon of biological (as opposed to fossil/mineral) origin as measured by standard C14 radiocarbon analysis;

(2) having a freezing point of less than about −15° C.;
(3) having less than about 10 wt % of its content comprising acyclic isoalkanes; and
(4) having greater than about 15 wt %, (e.g., greater than about 20 wt %, or greater than about 30 wt %) of its content being saturated hydrocarbons with one or two rings (i.e., cycloalkanes).

In some examples, the intermediate transportation fuel portion can be further, or alternatively, characterized as a composition in which the fraction of saturated hydrocarbons with one or two rings is at least twice the fraction of saturated acyclic hydrocarbons (i.e., traditional isoalkanes). In some examples, the intermediate transportation fuel portion can be further characterized as a composition in which the fraction of saturated hydrocarbons with one or two rings is larger than the fraction of saturated acyclic hydrocarbons (i.e., traditional isoalkanes).

As noted above, transportation fuels have to meet certain specifications. The cold flow properties may be particularly challenging when making renewable fuels from lipid feedstock. For example, lipids may include linear molecular components which, in previously known methods, tend to hydrotreat to predominantly linear products, which may have relatively high pour, cloud, and freeze points. Consequently, conventional renewable fuels produced using previously known methods may need extensive isomerization/dewaxing to meet the cold flow property specification. In comparison, the present mixtures, including intermediate compositions, made using the present systems and methods surprisingly may be in a fuel without the need for isomerization, dewaxing, or other hydroprocessing.

Additional examples of fuel and fuel blends made using the present systems and methods will be elucidated below with reference to example data.

WORKING EXAMPLES

The following examples are intended to be purely illustrative, and not limiting of the present subject matter.

Example 1. Preparation of Renewable Fuel Intermediate Composition

A calcium oxide catalyst on alumina support was prepared by treating alumina with 17 wt % calcium acetate in water, drying at 120-140° C., and calcining at 480° C. The calcium oxide catalyst on alumina support had a packed density in the range of about 0.85 g/cc to about 0.95 g/cc; a pore volume in the range of about 0.44 to about 0.46 cc/g; a large pore content (pores>1000 Å) of about 0.33 cc/g to about 0.36 cc/g; an average pore diameter (D50) of about 130 Å to about 160 Å; and a surface area of about 80 $m^2/g$ to about 120 $m^2/g$.

In the manner described with reference to FIGS. 1 and 2, the example lipid feedstocks soybean oil (SBO) and choice white grease (CWG) were flowed over the fixed-bed calcium oxide catalyst on an alumina support, in the presence of steam, to respectively generate intermediate compositions. The reaction was performed at about 900° F. at the following combinations of conditions: a liquid hourly space velocity (LHSV, oil feed basis) of about 1 $h^{-1}$ on oil basis, and a reaction vessel pressure (start of run) of 100-200 psig.

Two distillation cuts of the mixture resulting from this processing were obtained and compared to typical diesel properties (ASTM D975 specification) using ASTM standard tests. The first distillation cut corresponded to light diesel (boiling range 250-300° F.), and the second distillation cut corresponded to diesel (boiling range 300-680° F.). Table 1 below lists selected properties of the two distillation cuts. From Table 1, it may be understood that the cetane number is negatively impacted by the olefin and cycloparaffin content relative to a conventional renewable diesel fuel that is primarily normal and isoparaffins. The cloud point, pour point, freezing point, and CFPP are strongly influenced by chosen cut points, with lower distillation end points improving (lowering) the values. The high frequency reciprocating rig (HFRR) lubricity is likely positively influenced by the presence of the ketones in the sample. This particular light diesel cut did not meet the minimum viscosity at 40° C. requirement, but this may be fixed by selecting a higher distillation end point for the sample. Additionally, the PetroOxy for the light diesel is fairly short, likely due to the high olefin content. The distillation end point may be extended to lower the olefin content, and/or the initial boiling point may be increased, though potentially to the detriment of cold temperature properties. Some properties (DCN, D86, D93, D130, D7548, D482) were not measured for the light diesel cut.

TABLE 1

| Test | ASTM Method | ASTM D975 Specification | Light diesel cut | Diesel cut |
|---|---|---|---|---|
| Density ($g/cm^3$) | D4052 | | 0.768516 | 0.830391 |
| API Gravity | D4052 | | 52.451 | 38.741 |
| Derived Cetane Number (IQT) | D6890 | D975 40, min CARB 53, min | — | 52.585 |
| Pour Point (° C.) | | | <−79.9, <−80.0 | −2.1 |
| Cloud Pt (° C.) | D2500 | Report | −70.5 | −2.0 |
| Freezing Pt (° C.) | | | −86.1 | 4.5 |
| CFPP (° C.) | D6371 | Report | −51.0 | −2.1 |
| Distillation Temperature, 90% recovered max (° C.) | D86 | 338 | — | 333.72 |
| HERR (μm) | D6079 | 520, max | 411 | 256 |
| Flash Point (° C.) | D93 | 52, min | — | 64 |
| Viscosity at 40° C. (mm2/sec.) | D445 | 1.9 - 4.1 | 0.7271 | 2.376 |
| Cu Strip Corrosion | D130 | No. 3, max | — | 1b |
| PetroOxy (min) | D7545 | | 13.75 | 57.31 |
| PetroOxy (kPa) | D7545 | | 1099 | 994 |
| NACE Corrosion | D7548 | | — | C |
| Ash (Wt %) | D482 | | — | <0.010 |
| Ramsbottom carbon residue* (10% Dist) (Wt %) | D524 | | 0.04 | 0.09 |
| Sulfur (mg/kg) | D5453 | | 12 | 7.7 |
| Nitrogen (mg/kg) | D4629 | | 36 | 40 |
| Chlorides ppmw | GLS-26302 | | <1 | <1 |

Table 2 lists the percent by volume of olefins, aromatics, and saturates in the two distillation cuts. From Table 2, it may be understood that the majority of the olefinic molecules are concentrated in the lower boiling range of the mixture.

TABLE 2

| Test | ASTM Method | Units | Light diesel cut | Diesel cut |
|---|---|---|---|---|
| Olefins | D1319 | vol % | >55.0 | 4.9 |
| Aromatics | D1319 | vol % | 5.4 | <5.0 |
| Saturates | D1319 | vol % | 27.7 | 91.5 |

Table 3 lists the percent recovery of the diesel distillation cut at different temperatures. From Table 3, it may be understood that the D86 distillation of the diesel cut (300-680° F.) shows a normal distillation profile, similar to petroleum derived diesel fuel, and meets the T90 temperature requirement of being in the range of 282-338° C. for diesel #2 and therefore may be useable as a direct diesel fuel without blending.

TABLE 3

| Distillation | ° F. | ° C. |
|---|---|---|
| IPB | 316.43 | 158.02 |
| 5% recovery | 366.4 | 185.78 |
| 10% recovery | 383.3 | 195.17 |
| 20% recovery | 415.38 | 212.99 |
| 30% recovery | 449.74 | 232.08 |
| 40% recovery | 482.87 | 250.48 |
| 50% recovery | 514.47 | 268.04 |
| 60% recovery | 542.29 | 283.49 |
| 70% recovery | 570.51 | 299.17 |
| 80% recovery | 600.65 | 315.92 |
| 90% recovery | 631.88 | 333.27 |
| 95% recovery | 651.48 | 344.16 |
| Final BP | | |
| Recovery (vol %) | 98.4 | |
| Residue | 1.4 | |
| Loss | 0.2 | |

Table 4 lists the amounts of impurities (analytes) measured in the two distillation cuts, measured using inductively coupled plasma-mass spectrometry (ICP-MS). Where the less-than symbol (<) is used in Table 1, it means that the concentration of the impurity was below the instrument's resolution for that impurity in that run (e.g., that the impurity was undetectable).

TABLE 4

| Analytes | Concentration of analyte in light diesel cut (ppm) | Concentration of analyte in diesel cut (ppm) |
|---|---|---|
| Al | <0.54 | <0.54 |
| Ba | <0.54 | <0.54 |
| Ca | <0.54 | <0.54 |
| Cd | <0.54 | <0.54 |
| Cr | <0.54 | <0.54 |
| Cu | <0.54 | <0.54 |
| Mg | <0.54 | <0.54 |
| Mn | <0.54 | <0.54 |
| Mo | <0.54 | <0.54 |
| Ni | <0.54 | <0.54 |
| Si | <0.54 | <0.54 |
| Ti | <0.54 | <0.54 |
| V | <0.54 | <0.54 |
| Zn | <0.54 | <0.54 |
| Fe | <1.1 | <1.1 |
| Na | <2.2 | <2.2 |
| P | <2.2 | <2.2 |
| Pb | <2.2 | <2.2 |
| Sn | <2.2 | <2.2 |
| K | <2.7 | <2.7 |
| B | 0.966 | 1.05 |

From the foregoing, it may be understood that systems and methods such as described with reference to FIGS. 1 and 2 suitably may be used to generate fuel, such as diesel fuel, without the need for further hydroprocessing.

Additional Comments

While various illustrative embodiments of the invention are described above, it will be apparent to one skilled in the art that various changes and modifications can be made therein without departing from the invention. The appended claims are intended to cover all such changes and modifications that fall within the true spirit and scope of the invention.

What is claimed is:

1. A method of generating a fuel blend, the method comprising:

flowing a lipid feedstock into a reaction vessel comprising a metal oxide catalyst on an oxide support;

using the metal oxide catalyst in the reaction vessel to catalytically convert the lipid feedstock into a mixture comprising an intermediate composition having at least 70% of its oxygen within ketone groups;

using distillation to obtain a distillation cut of the mixture;

without any further catalytic processing of the distillation cut, blending the distillation cut with a fuel to create a fuel blend.

2. The method of claim 1, wherein the distillation cut meets the Table 1 specifications of the ASTM D6751 standard.

3. The method of claim 1, wherein the fuel comprises a petroleum fuel or a renewable fuel.

4. The method of claim 3, wherein the petroleum fuel comprises diesel, or wherein the renewable fuel comprises biodiesel, hydrotreated lipids, or a mixture of biodiesel and hydrotreated lipids.

5. The method of claim 4, wherein the fuel blend meets the Table 1 specifications of the ASTM D7467 standard, other than the requirement that the fuel blend contain 6-20% (V/V) of biodiesel.

6. The method of claim 1, wherein the fuel blend meets the Table 1 specifications of the ASTM D7467 standard, other than the requirement that the fuel blend contain 6-20% (V/V) of biodiesel.

7. The method of claim 4, wherein the fuel blend comprises 6-20% (V/V) biodiesel, and wherein the fuel blend meets the ASTM D7467 standard.

8. The method of claim 1, wherein the fuel blend comprises about 5% to about 50% by volume of the distillation cut.

9. The method of claim 8, wherein the fuel blend comprises about 5% to about 25% by volume of the distillation cut.

10. The method of claim 1, wherein the fuel blend comprises more than about 50% by volume of the distillation cut.

11. The method of claim 1, wherein the distillation cut is from about 200° F. to about 750° F.

12. The method of claim 11, wherein the distillation cut is from about 300° F. to about 680° F.

13. The method of claim 1, wherein at least 90% of carbon in the fuel blend is from a biological source.

14. A fuel blend, comprising:

a distillation cut of a mixture comprising an intermediate composition having at least 70% of its oxygen within ketone groups; and a petroleum fuel or a renewable fuel.

15. The method of claim 14, wherein the petroleum fuel comprises diesel, or wherein the renewable fuel comprises biodiesel, hydrotreated lipids, or a mixture of biodiesel and hydrotreated lipids.

16. The method of claim 14, wherein the distillation cut meets the Table 1 specifications of the ASTM D6751 standard.

17. The method of claim 14, wherein the fuel blend meets the Table 1 specifications of the ASTM D7467 standard, other than the requirement that the fuel blend contain 6-20% (V/V) of biodiesel.

18. The fuel blend of claim 14, wherein the mixture is formed by flowing a lipid feedstock into a reaction vessel comprising a metal oxide catalyst on an oxide support.

19. The fuel blend of claim 14, consisting essentially of the distillation cut and the petroleum fuel or the renewable fuel.

20. The fuel blend of claim 14, wherein the fuel blend comprises about 5% to about 50% by volume of the distillation cut.

21. The fuel blend of claim 20, wherein the fuel blend comprises about 5% to about 25% by volume of the distillation cut, or wherein the fuel blend comprises about 25% to about 50% by volume of the distillation cut.

22. The fuel blend of claim 14, wherein the fuel blend comprises more than about 50% by volume of the distillation cut.

23. The fuel blend of claim 14, wherein the distillation cut is from about 200° F. to about 750° F.

24. The fuel blend of claim 23, wherein the distillation cut is from about 300° F. to about 680° F.

25. The fuel blend of claim 14, wherein the fuel blend comprises 6-20% (V/V) biodiesel, and wherein the fuel blend meets the ASTM D7467 standard.

26. The process of claim 1, wherein hydrogen is not separately added to the reaction vessel during the catalytic conversion of the lipid feedstock.

* * * * *